US007083294B2

(12) United States Patent
Steinberg

(10) Patent No.: US 7,083,294 B2
(45) Date of Patent: Aug. 1, 2006

(54) REUSABLE AND RECHARGEABLE GLOW DEVICE

(76) Inventor: Benjamin H. Steinberg, 535 S. Park Ridge, Apt. 13101, Bloomington, IN (US) 47401

( * ) Notice: Subject to any disclaimer, the term of this patent is extended or adjusted under 35 U.S.C. 154(b) by 0 days.

(21) Appl. No.: 10/779,996

(22) Filed: Feb. 18, 2004

(65) Prior Publication Data

US 2005/0180126 A1 Aug. 18, 2005

(51) Int. Cl.
*F21K 2/00* (2006.01)

(52) U.S. Cl. ..... 362/34

(58) Field of Classification Search ..... 362/34; 446/219; 252/700; 206/219–222, 524.1
See application file for complete search history.

(56) References Cited

U.S. PATENT DOCUMENTS 3,800,132 A * 3/1974 Postal ..... 362/34
3,884,560 A * 5/1975 Neylan et al. ..... 359/867
4,678,608 A 7/1987 Dugliss
5,122,306 A 6/1992 Van Moer
5,488,544 A * 1/1996 Ladyjensky ..... 362/34
5,552,968 A 9/1996 Ladyjensky
6,012,820 A 1/2000 Weber
6,106,129 A 8/2000 Cranor
6,126,871 A 10/2000 Cranor
6,267,914 B1 7/2001 Cranor
6,461,543 B1 10/2002 Earl

FOREIGN PATENT DOCUMENTS

DE 3411194 A * 10/1985
GB 2013704 * 8/1979

* cited by examiner

*Primary Examiner*—Sandra O'Shea
*Assistant Examiner*—Sharon Payne

(57) ABSTRACT

The present invention discloses a reusable and rechargeable glow device, whereby the glow device is reused by refilling the device with the necessary chemicals while also being rechargeable between refills through use of a graduated introduction system with regard to the chemicals necessary to provide a chemiluminescent reaction.

28 Claims, 1 Drawing Sheet

REUSABLE AND RECHARGEABLE GLOW DEVICE

CROSS-REFERENCE TO RELATED APPLICATIONS

Not Applicable

STATEMENT REGARDING FEDERAL SPONSORED RESEARCH OR DEVELOPMENT

Not Applicable

REFERENCE TO SEQUENCE LISTING, ETC.

Not Applicable

BACKGROUND

The present invention relates to a chemical glow device that is reusable and rechargeable. More particularly, the present invention relates generally to a glow device that can be reused many times by being refilled with the necessary chemicals while at the same time being rechargeable between refills, so each refill can afford multiple uses of the glow device.

Lighting devices based on chemiluminescent emission generated by the mixing of two chemicals are already commonly known. See U.S. Pat. No. 4,678,608 which is incorporated in the present description by reference. The chemiluminescence is produced by a reaction in the liquid phase of an activator such as hydrogen peroxide with a flourescent agent and an oxalate. Optionally, other secondary compounds may also be present, generally flourescent agents modifying the characteristics of the emitted light.

Also known is a method by which such devices can be made of translucent synthetic material containing two chambers whereby external force is applied to the device until the membrane separating the two chambers moves and/or fails and a chemical reaction is seen producing chemiluminescence. See U.S. Pat. No. 5,552,968 which is incorporated in the present description by reference. Further it is well known that the chemicals involved can be chosen and/or manipulated to obtain a variety of colors of chemiluminescent light, such as red or orange. See U.S. Pat. Nos. 5,122,306 and 6,461,543.

Notwithstanding the above, these prior devices have been limited to single-use or single chemical reaction devices. Thus, there exists a significant demand for a device that provides chemiluminescent light which is reusable and rechargeable.

BRIEF SUMMARY

The present invention is directed to the needs and desires noted above for a reusable and rechargeable glow device that can be reused by refilling the device with the necessary chemiluminescent chemicals and also rechargeable between refills by using a graduated system of introducing the chemiluminescent liquids to produce chemiluminescent light. It is a further object of this invention that a user be allowed to adjust the amount of light or glow provided by adjusting the amount of chemiluminescent chemicals mixed together through use of the graduated system or device. Furthermore, it is an object of this invention that the device be a variety of sizes and/or shapes depending upon the needs of the user, produce a variety of light colors and be producible at a low cost to allow many people to purchase and use these devices.

These and other features, aspects and advantages of the present invention will become better understood with reference to the following description, appended claims and accompanying drawing.

DESCRIPTION

Figure 1:
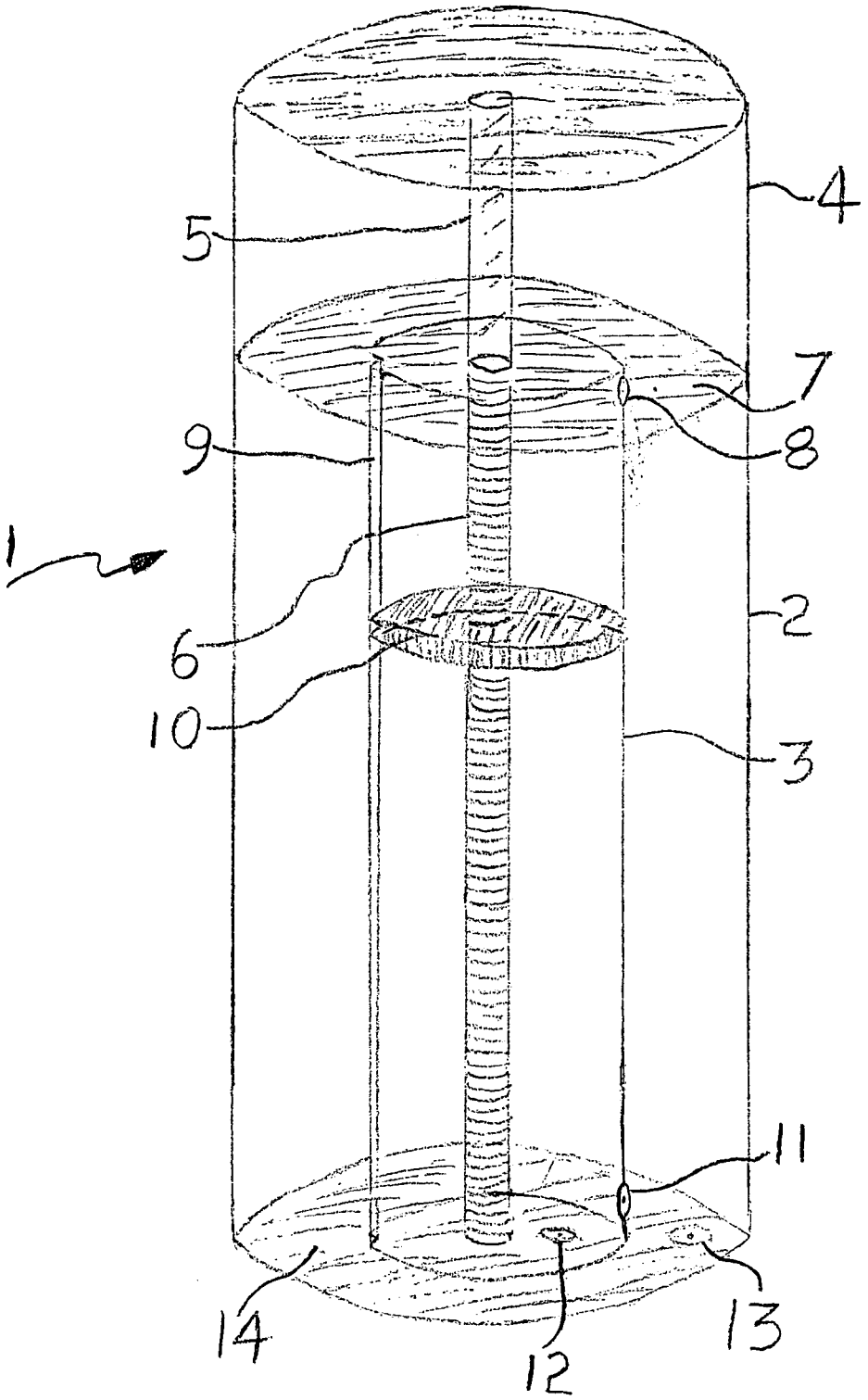
FIG. 1: shows a schematic of one claimed embodiment.

The reusable and rechargeable glow device of this invention may be produced by use of a container having translucent features and containing two chambers. Each chamber contains at least one chemical product which reacts with the other chemical to produce a chemiluminescent reaction. The chemicals of the two chambers are mixed in a gradual manner through use a system by which the amount of the chemicals mixed can be manually adjusted by the user. This flexibility will allow the user to repeatedly create a chemiluminescent reaction by only mixing a limited portion of the chemiluminescent chemicals contained in the device during a specified period. Likewise, once all the chemical products in the device have been mixed and the chemiluminescent reaction has ceased, a user may empty the device of this liquid and refill the two chambers, separately, with the chemiluminescent chemicals necessary to make further reactions.

The invention can be better understood with reference to the attached drawing, illustrating a representative and non-limiting embodiment.

FIG. 1 shows a reusable and rechargeable glow device as claimed herein. The glow device, 1, consists of a translucent outer wall 2 and an substantially parallel inner wall 3 whereby the space between 2 and 3 creates a first chamber which is substantially enclosed by material traversing the space between 2 and 3 on both ends of the chamber as shown by 7 and 14. A second chamber is found inside the parallel inner wall 3, which is also substantially enclosed by material traversing the open chamber on both ends, 7 and 14.

There is also present a first valve, in this embodiment piercing the surface 14, which first valve allows the introduction of chemiluminescent chemicals into the first chamber, but not into the second chamber. This valve may also allow for the emptying of chemicals from the first chamber. It is also possible that there could be two separate valves attached to the first chamber, but not the second chamber, whereby one allows for the introduction of the chemicals and the second allows for emptying of the chemicals.

In the embodiment shown in FIG. 1, piercing the surface 14, there is also present a second valve, which second valve allows for the introduction of chemiluminescent chemicals into the second chamber, but not into the first chamber.

There is further a third valve 11 between the first chamber and second chamber. This third valve only allows a specified amount of chemicals from one of the chambers to proceed to the other chamber, but not return to the original chamber. In this embodiment, this third valve allows chemiluminescent chemicals to flow from the second chamber to the first chamber.

There is also provided a means by which a specified amount of chemicals are forced from the second chamber into the first chamber, through the third valve, which then allows for the mixing of the chemicals causing a chemiluminescent reaction.

In the embodiment of FIG. 1 a knob 4 is attached to a shaft 5 which extends through the surface 7 and into the second chamber continuing lengthwise until it terminates at the other end of the second chamber at surface 14. The shaft 5 contains spherical splines in the area of the shaft that is contained in the second chamber. A disk 10, containing mating spherical acceptors, is then attached to the shaft on the spherical splines which allows the disk to the moved lengthwise along the shaft when the shaft is rotated by a turning of knob 4. A channel 9, which matches a notch in the disk, ensures that the disk will move lengthwise along the shaft and not merely spin along with the shaft 5 when it is rotated via knob 4.

There is also provided a hole 8 between the first chamber and second chamber which is blocked by the disk when it is in its first position. This first position is characterized by the fact that no chemiluminescent reaction has taken place and the second chamber is completely filled with the second chemical. Thereafter, a chemiluminescent reaction is obtained by turning knob 4, which rotates shaft 5 moving disk 10 and thereby introducing a desired amount of the second chemical into the first chemical, which then causes a chemiluminescent reaction.

Due to the fact that the first chamber and the second chamber are closed to ambient air, during the chemiluminescent process, the volume of the second chemical will change as the disk 10 is moved lengthwise along the shaft 5. In order to ensure that the total volume of liquid in chambers one and two remains constant, hole 8 will allow for the flow of chemicals from the first chamber into the second chamber, in the area above the disk 10, to maintain a constant total volume and avoid possible failure of the either chamber one or two due to excessive liquid pressure or volume.

Although the present invention has been described in considerable detail with reference to certain preferred versions thereof, other versions are possible. Therefore, the spirit and scope of the appended claims should not be limited to the description of the preferred versions contained herein.

What is claimed is:

1. A reusable and rechargeable glow device comprising:
a) a translucent container with two chambers;
b) whereby each chamber contains at least one chemical product which reacts with the other chemical to produce a chemiluminescent reaction;
c) a means in which to allow for a graduated introduction of one of the chemicals from one chamber to the other;
d) and further comprising a means whereby the chemicals can be removed from the container and new chemicals introduced, separately, into the two chambers to allow for further chemiluminescent reactions.

2. The device of claim 1 whereby the container is a cylindrical shape.

3. The device of claim 1 whereby the container is in such a shape that it could be placed on or near a hazard cone or similar device.

4. The device of claim 1 whereby the container has an exterior that is colored or imprinted to increase the effectiveness of the chemiluminescent light produced or to provide entertainment or novelty.

5. The device of claim 1 whereby the container is of sufficient size to allow for an extended chemiluminescent reaction lasting hours long.

6. The device of claim 1 whereby the chemicals are varied to change the color of the light produced by the chemiluminescent reaction.

7. A reusable and rechargeable glow device comprising:
a) a translucent container with two chambers;
b) whereby each chamber contains at least one chemical product which reacts with the other chemical to produce a chemiluminescent reaction;
c) a means in which to allow for a controlled graduated introduction of one of the chemicals from one chamber to the other, giving the user the means to stop the graduated introduction at any time and to further reintroduce chemical reactants causing additional reactions after expiration of previous reactions.

8. The device of claim 7 whereby the container is a cylindrical shape.

9. The device of claim 7 whereby the container is in such a shape that it could be placed on or near a hazard cone or similar device.

10. The device of claim 7 whereby the container has an exterior that is colored or imprinted to increase the effectiveness of the chemiluminescent light produced or to provide entertainment or novelty.

11. The device of claim 7 whereby the container is of sufficient size to allow for an extended chemiluminescent reaction lasting hours long.

12. The device of claim 7 whereby the chemicals are varied to change the color of the light produced by the chemiluminescent reaction.

13. A reusable and rechargeable glow device comprising:
a) a translucent container with at least two chambers;
b) whereby each chamber contains at least one chemical product which reacts with the other chemical to produce a chemiluminescent reaction;
c) whereby each chamber is separated by gaskets or similar means to prevent unintended leakage from one chamber to another or from the apparatus generally;
d) a means in which to allow for a graduated introduction of one of the chemicals from one chamber to the other;
e) and further comprising a means whereby the chemicals can be removed from the container and new chemicals introduced, separately, into the two chambers to allow for further chemiluminescent reactions.

14. The device of claim 13 whereby the gasket or similar means between the two chambers, consists of a rubber cork system.

15. The device of claim 13 whereby the gasket or similar means associated with the graduated introduction means, includes a petroleum based lubricant such that the pressure necessary to cause leakage at #10 is greater than the pressure to activate the gasket or similar means between the two chambers, #11 in FIG. 1.

16. The device of claim 13 whereby the gasket or similar means associated with the graduated introduction means, includes a petroleum based lubricant such that the pressure necessary to cause leakage at is greater than the pressure to activate the rubber cork system.

17. A reusable and rechargeable glow device comprising:
a) a translucent container with at least two chambers;
b) whereby each chamber contains at least one chemical product which reacts with the other chemical to produce a chemiluminescent reaction;
c) whereby each chamber is separated by gaskets or to prevent unintended leakage from one chamber to another or from the apparatus generally;
d) a means in which to allow for a controlled graduated introduction of one of the chemicals from one chamber to the other, giving the user the means to stop the graduated introduction at any time and to further re-introduce chemical reactants causing additional reactions after expiration of previous reactions.

18. The device of claim 17 whereby the gasket or similar means between the two chambers, consists of a rubber cork system.

19. The device of claim 17 whereby the gasket or similar means associated with the graduated introduction means, includes a petroleum based lubricant such that the pressure necessary to cause leakage at is greater than the pressure to activate the gasket or similar means between the two chambers.

20. The device of claim 17 whereby the gasket or similar means associated with the graduated introduction means, includes a petroleum based lubricant such that the pressure necessary to cause leakage at is greater than the pressure to activate the rubber cork system.

21. A reusable and rechargeable glow device comprising:

a) a translucent container with two chambers, one inner and one outer;

b) whereby each chamber contains at least one chemical product which reacts with the other chemical to produce a chemiluminescent reaction;

c) the inner chamber being such that no external light could reach or react with the chemical product contained therein;

d) a means in which to allow for a graduated introduction of one of the chemicals from one chamber to the other;

e) and further comprising a means whereby the chemicals can be removed from the container and new chemicals introduced, separately, into the two chambers to allow for further chemiluminescent reactions.

22. The device of claim 21 whereby the inner chamber is made of a material that will break or shatter upon external force, providing the user the option to have immediate and complete mixing or a controlled graduated introduction of the chemical products.

23. The device of claim 21 whereby the means allowing for controlled graduated introduction are such that they only allow for one-way mixing or, in other words, reduction of the volume of one of the chambers containing chemicals yet to be mixed, but not the other.

24. The device of claim 21 whereby the inner chamber is opaque only where necessary to protect the chemical products inside, to maintain longevity, and the opaque nature of the chambers reduces as the volume of the chemical inside are reduced through the controlled and graduated introduction to the second chemical reactant.

25. A reusable and rechargeable glow device comprising:

a) a translucent container with two chambers, one inner and one outer;

b) whereby each chamber contains at least one chemical product which reacts with the other chemical to produce a chemiluminescent reaction;

c) the inner chamber being such that no external light could reach or react with the chemical product contained therein;

d) a means in which to allow for a controlled graduated introduction of one of the chemicals from one chamber to the other.

26. The device of claim 25 whereby the inner chamber is made of a material that will break or shatter upon external force, providing the user the option to have immediate and complete mixing or a controlled graduated introduction of the chemical products.

27. The device of claim 25 whereby the means allowing for controlled graduated introduction are such that they only allow for one-way mixing or, in other words, reduction of the volume of one of the chambers containing chemicals yet to be mixed, but not the other.

28. The device of claim 25 whereby the inner chamber is opaque only where necessary to protect the chemical products inside, to maintain longevity, and the opaque nature of the chambers reduces as the volume of the chemical inside are reduced through the controlled and graduated introduction to the second chemical reactant.

* * * * *